US007684169B1

(12) United States Patent
Larkin

(10) Patent No.: US 7,684,169 B1
(45) Date of Patent: Mar. 23, 2010

(54) PROTECTIVE IONIZING SURFACE FOR ELIMINATING STATIC

(75) Inventor: William J. Larkin, Swampscott, MA (US)

(73) Assignee: Alpha Innovation, Inc., Marblehead, MA (US)

( * ) Notice: Subject to any disclaimer, the term of this patent is extended or adjusted under 35 U.S.C. 154(b) by 0 days.

(21) Appl. No.: 12/264,995

(22) Filed: Nov. 5, 2008

(51) Int. Cl.
*H01T 23/00* (2006.01)

(52) U.S. Cl. ..... 361/231

(58) Field of Classification Search ..... 361/231
See application file for complete search history.

(56) References Cited

U.S. PATENT DOCUMENTS 5,501,899 A * 3/1996 Larkin ..... 442/110
5,690,014 A 11/1997 Larkin
5,740,006 A 4/1998 Larkin
6,522,077 B2 2/2003 Larkin
6,750,164 B2 6/2004 Larkin

* cited by examiner

*Primary Examiner*—Stephen W Jackson
(74) *Attorney, Agent, or Firm*—Antoinette G. Giugliano PC

(57) ABSTRACT

The present invention relates to a protective ionizing device, or protective static eliminator, and methods, systems, apparatus and kits using the device. The device has a surface having a series of (e.g., one or more) grooves or gaps, each groove defines a space; and a multiplicity of ionizing points suspended in the space, just below the upper surface of the device. The ionizing points can be suspended on braided microfibers, on an extruded surface in the groove, on an elastic cord, or on a wire core.

The device is useful for the efficient elimination of static charge build-up on a surface of insulative material while maintaining and protecting the ionizing points.

17 Claims, 6 Drawing Sheets

PROTECTIVE IONIZING SURFACE FOR ELIMINATING STATIC

BACKGROUND OF THE INVENTION

Prior to the present invention, a limitation of certain static eliminators is that they are only effective when the field of the charged object is undisturbed and in space (i.e., not in contact with other objects). When a charged object is in contact with or in close proximity to another object or surface, the field is disturbed and induced toward the other object or surface. For example, when a flat material such as a sheet of plastic is charged and placed in contact with another flat surface, the charge on the plastic sheet induces toward the other surface, causing the plastic sheet to cling to the flat surface. Concurrently, the voltage field on the opposite (non-contacting) side of the plastic sheet is generally not available for induction to a nearby static eliminator or for charge neutralization.

Static charge build-up can cause problems in a variety of settings, especially in the printing industry. In the case in which a sheet is moving across a flat surface or in contact with a roller, the voltage from the sheet is attracted toward the surface. The voltage is induced toward the surface. As such, there is no voltage on the upper side of the sheet, but only on the bottom side of the sheet induced toward the surface. A static field meter on the upper side often reads near zero levels.

In this case, static eliminators that are placed or swiped above the upper side of the sheet often do not eliminate the suppressed voltage (e.g., the voltage induced toward the surface) because little or no excess voltage exists above the sheet. Additionally, attempts to place a static eliminator below the sheet have posed a challenge in many instances. For example, placing a static eliminating cord or rod would interfere with the sheet's ability to move across the surface. Using static eliminating tape under the sheet results in tape that eventually gets abraded, damaged, or otherwise becomes ineffective after a certain amount of use.

Hence, a need exists for a static eliminator that can eliminate static on the induced surface side of a sheet. In particular, this need exists to efficiently eliminate static without interfering with the flow of the sheet or the machine on which it is used. A further need exists to do so without wearing down or abrading the ionizing points of the static eliminator.

SUMMARY OF THE INVENTION

The protective ionizing device of the present invention has a surface having a series of grooves, each groove defines a space; and a plurality of electrically conductive microfibers having a multiplicity of ionizing points suspended e.g., in space, below or just below the upper surface of the device. When the device is grounded, air between the ionizing points and material passing by the upper surface is sufficiently ionized to remove or reduce static charge from the material. In an embodiment, the device of the present invention has a profile ranging between about 1/32 inch and about 1/4. In one aspect, the invention further includes a wire core suspended just below the upper surface, wherein the microfibers braided along the at least a portion of the length of the wire core. The device can be adapted for use in an apparatus through which insulative material flows or is propelled. The wire core is, in an embodiment, suspended at a distance between about 1/64 inch and about 1/8 inch below the upper surface, and in an embodiment between about 1/64 inch and about 1/16 inch. The microfibers used in the present invention embody a diameter between about 0.5 and 50 microns and a length between about 1/32 inch and 3 inches. The wire core and/or electrically conductive microfibers can be made from a variety of materials, including, e.g., carbon, metal coated carbon, copper, stainless steel, metal coated acrylic, metallized acrylic, electrically conductive polymers, static dissipative polymers and any combination thereof. The ionizing points can be suspended on braided microfibers, on an extruded surface in the groove, on an elastic cord, or on a wire core. In particular, the ionizing points can be flocked, glued, spun, or sewn along the length of the wire core. The surface of the device can be made from a material selected from an insulative material or a conductive material. The material can be plastic, metal, foam, paper, film, textile, wood, or a combination thereof.

The present invention also relates to a protective ionizing device having an upper surface, and the device has a tapered extrusion next to which the conductive microfibers are disposed. The tapered extrusion, in an embodiment, is made from insulative material. A preferred embodiment is plastic, but the present invention can also be made from metal, paper, wood, or textile. The tapered extrusion is formed from a first side having a first height that slopes to a second side having a second height that is less that the first height (e.g., a wedge with one side having a height that is higher than the other side). A plurality of electrically conductive microfibers having a multiplicity of ionizing points suspended at or along the first side just below the upper surface.

The present invention further includes apparatus, system, or assembly through which insulative material flows or is propelled. The apparatus, system, or assembly includes a protective ionizing device, as described herein, and the machine with which it is used (e.g., printing press). The device of the present invention is positioned proximal to or on a surface at which insulative material flows or propels.

The present invention further includes methods for removing static charge or reducing static charge on a surface of material. The methods include the steps of subjecting the static charge to a protective ionizing device, as described herein, wherein the air between the ionizing points and material subjected thereto is ionized to remove or reduce static charge from said material. In an embodiment, the method includes positioning the protective ionizing device underneath insulative material being propelled.

Yet another embodiment of the present invention is a protective ionizing kit. The kit includes a surface having a series of grooves, each groove defines a space; a plurality of electrically conductive microfibers having a multiplicity of ionizing points. In an embodiment, the kit further includes a wire core or an elastic member on which the ionizing points are attached. As such, the kit further includes an attachment or means for attaching the wire core or elastic member to the device.

The present invention advantageously allows for the elimination of static on the surface side of a sheet. The device of the present invention efficiently eliminates static without compromising the workflow of the sheet or the machine. The machine is able to process more sheets without running into problems (e.g., jamming, cling, drag, misalignment, etc.) associated with static. Additionally, the device of the present invention eliminates static without wearing out or being abraded.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1A:
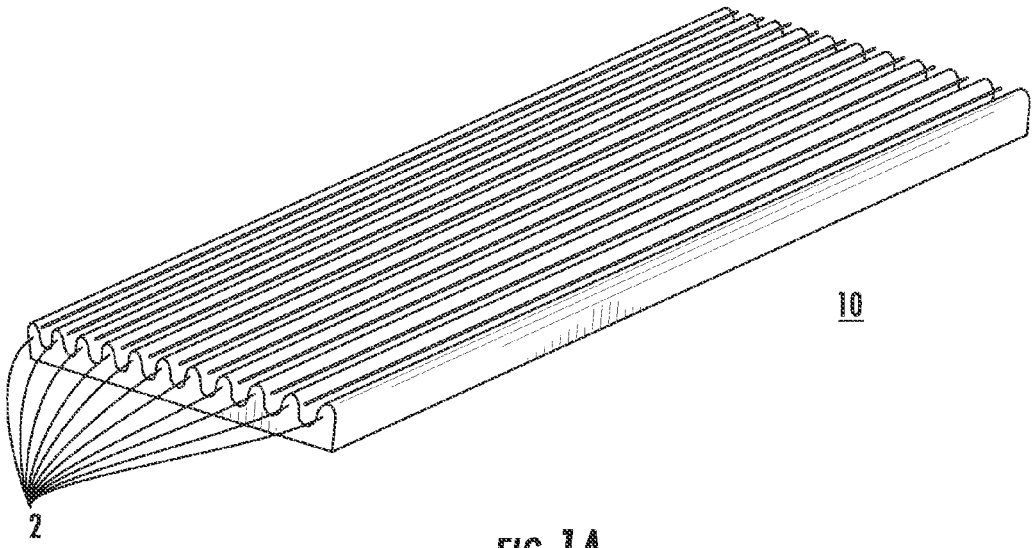
FIG. 1A is a drawing of a perspective view of an embodiment of the present invention of a protective ionizing surface that has a series of braided, ionizing wire suspended in air in a series of grooves.

A description of preferred embodiments of the invention follows.

The present invention relates to a protective ionizing surface (PIS) that includes an ionizing wire suspended in a plurality of spaces or channels. The ionizing wire has a number of ionizing points to ionize air in close proximity to the outer surface of the device and remove or reduce static charge from a surface (e.g., insulative, conductive and/or semi-conductive surfaces). The ionizing wire, in an embodiment, is made up of a core and braided microfibers that contain a number of ionizing points. The present invention offers a novel surface which can remove the charge from a sheet, web, or object placed on it or passing closely over it. Furthermore, the present invention can support the sheet, web or object, and, at the same time, protect the ionizing points while overcoming capacitance and voltage suppression.

Static electricity is defined herein as surface storage of electric charge. This surface charge is caused by induction or by the transfer of electrons when two similar or dissimilar surfaces contact. The charge also creates a voltage field which attracts or repels other objects which are proximate to the field.

When a statically charged object (e.g., a piece of tape) is suspended in air, and not near another object, the voltage field will induce out in all directions. When a charged object is in contact with or in close proximity to another object or surface, the field is disturbed and the electrons are induced toward the other object or surface. For example, when the piece of tape is laid on a flat surface, the field is inducing or "clinging" to the flat table surface and there is no voltage inducing out from the exposed top surface. The charge induces out toward any object nearby. This is "static attraction." When the voltage is attracting in one direction, the voltage is suppressed from the other directions and is not inducing from the exposed side. Hence, the top side of the charged tape or sheet of plastic has no voltage induction, so static eliminators or ionizers cannot neutralize the charge. In converting machines, rollers carrying webs or sheets are close in proximity to one another and results in a higher capacitance. On printing machines, the stack of sheets are in close proximity to themselves on the stack and the feed board surface as they are fed into the press. This involves higher capacitance and voltage suppression.

Capacitance affects the voltage and makes the voltage difficult to remove with conventional air ionizing devices, both active and passive. When a sheet is lying flat on a stack or in contact with a roller or moving across a flat surface, the voltage is attracted toward the surface and induces toward it. Some refer to this as voltage suppression because there is little voltage on the upper side of the sheet. A static field meter reads near zero levels. This phenomenon can be explained by the formula for static charge, $$Q=V/C$$

where Q represents the static charge, V represents the voltage, and C represents the capacitance of a statically charged material. When a charged object is in space, C=1. Thus all of the voltage pressure is available for static removal by induction or active ionization. As the capacitance, C, increases due to proximity of the statically charged object to another object, less voltage pressure (V) is available for induction or active ionization. As demonstrated in the example below, it is the voltage that pushes the charge to ionize:

$$Q = \frac{10KV}{C1} \quad Q = S \quad 10KV$$

$$Q = \frac{10KV}{C2} \quad Q = S \quad 5KV$$

$$Q = \frac{10KV}{C5} \quad Q = S \quad 2KV$$

Additionally, an insulative material in motion can contact another surface causing triboelectric generation of static charge and the resulting cling without ever separating from the surface. Static generation is most commonly observed when similar and dissimilar materials contact and separate. However, the static generation occurs as soon as one material touches the other. As the molecules of one material closely approach those of another material, there is a transfer of electrons, generating a static charge. Whenever there is high capacitance and insufficient voltage pressure to induce or actively ionize, contact between objects will generate static charge and the resultant static problems, i.e., cling, drag, misalignment, electrostatic discharge (ESD), etc.

The present invention provides a ionizing surface of conductive points on a core that is protected from the use in an apparatus while capable of neutralizing static charge on an insulative material on or near its surface.

Figure 1B:
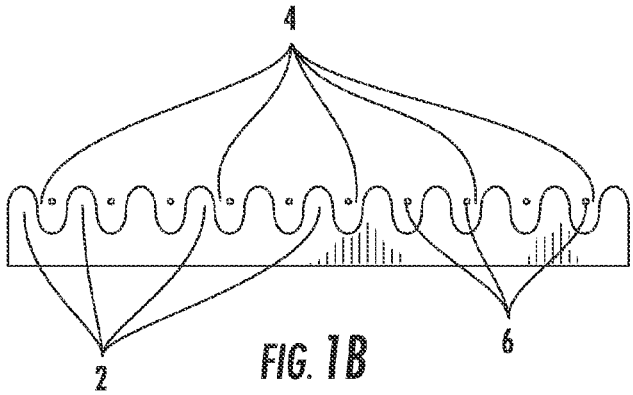
FIG. 1B is a drawing of a side view of the embodiment shown in FIG. 1A.

More specifically, referring to FIG. 1, PIS 10 of the present invention relates to a device having series of low profile grooves 2 that define space 4 for suspension of an ionizing wire 6. An ionizing wire, as used herein, is a wire having a multiplicity of ionizing points disposed along the wire. As shown in the in the figure, grooves are used to create a space to suspend the ionizing wire having conductive points on core. In addition to a groove, any shaped surface can be used to create a space in which to suspend the ionizing points. The spaces can be created by a series of bars, curved surfaces, slots, pockets, in addition to grooves. See FIGS. 2A and 3A. In an embodiment, the gap or space can be created by a wedge or extrusion, as shown in FIG. 6. In an embodiment, the surface can be any shape so long as the shape creates a space in which to suspend the ionizing wire. The cross-section of the device shown in FIG. 1A has rounded "U" shaped grooves. In other embodiments, when looking at the cross-section of the device, the shape of the surface can form a elliptical shape, a semi-circle shape, a square "U" shaped, a "V" shape, an irregular shape, a wedge shape, or any shape that provides a space or channel in which the ionizing points can be suspended. In yet another embodiment, the surface into which ionizing points are suspended can be a grid (e.g., a stainless steel grid) having spaces or channels. Such a grid can be removable for cleaning or disposal e.g., for medical, pharmaceutical or food preparation applications. The device and the grooves, in an embodiment, have a low profile so as to fit in machinery involved in having insulative material passing through it. In an embodiment, the height can be large because the depth of the groove is not limited. In certain cases, the depth of the groove can be about ½ inch or more (e.g., ¾ inch, 1 inch). Accordingly, the height or profile of the device has a range between about 1/32 inch and 1 inch, and in an embodiment between about 1/32 inch to about ¼ inch. The width or upper opening can range from about 1/32 inch to about ½ inch. In an aspect, the number of ionizing points depend on a number of factors: 1) the size of the points and the diameter of the conductive fibers; and 2) the placement of fibers in the groove to minimize voltage suppression as the voltage induces toward them. In general, the smallest series of conductive points in space in the groove with the least mass and the high conductivity will allow the voltage to induce to the points on the wire more effectively and at a lower threshold. A lower the profile makes the PIS of the present invention easier to place on or flush with the surface of a table, inside a tote box or machine. Additionally, the ionizing points on the wire can also be made smaller to ionize the air effectively. The low profile could also be used to line tote boxes so that charged objects can be placed down on it to minimize charging.

In addition to having a series of grooves 2, PIS 10 has a series of ionizing points on wires 6 suspended in grooves 2. Ionizing wire 6 is made, in part, from a conductive wire core (e.g., copper, graphite, or carbon cores). In an embodiment, the wire core is conductive. The conductive core wire can be important, in certain aspects, in high voltage applications to carry the charge to ground because it limits the length of travel of the current from the ionizing points of the microfibers to the core wire which has a thickness many times greater. Hence, the life spam of the micro fibers is extended. In other embodiments, the wire core can be non-conductive. Additionally, the ionizing points can be suspended in a form other than a wire. For example, ionizing points can be twisted or spun together. Conductive refers to a surface resistivity of 10E5 per ASTM D 257. Insulative or non-conductive has a surface resistivity of >10E12 ohms per square per ASTM D 257, while static dissipative refers to a surface resistivity of between 10E5 and 10E12 per ASTM D 257. In one embodiment, microfibers with a multiplicity of ionizing points are braided along the length of the wire core. In addition to braiding points, the ionizing points can be flocked, glued, spun, or sewn along the length of the wire core. The fibers can be more fragile since they are protected by being suspended just below the ionizing surface. These microfibers electrically communicate with one another or are in conductive contact with each other. For example, when using an insulative core, electrically connected microfibers can be grounded. When using a conductive core, the microfibers can come into contact with the core, which is then grounded.

Ionizing points are created by the exposed tip of each of these microfiber ends. Ionizing points are also created by folded or sharply bent sections of microfibers, providing ionizing points randomly disposed along the length of the ionizing wire to remove static charge from insulative material passing the PIS. The ionizing points induce ionization by increasing the voltage pressure or potential at each microfiber ionizing point, inducing ionization of the air between the passing statically charged material and the microfiber ionizing points. The ionized air and the conductive ionizing points provide a path to ground the charge.

In particular, microfibers, as used herein, include fibers about 0.5-50 microns preferably about 5-10 microns in diameter and about 2-8 cm, preferably about 5 cm, long. As can be seen from these size ranges, although the fibers can be short the aspect ratio (length to diameter) of the fibers is high. The small cross-sectional area at each exposed microfiber end, fold, or sharp bend provides the required "ionizing points" to induce ionization. That is, the voltage pressure or potential at each microfiber ionizing point is increased, inducing ionization of the air between the passing statically charged material and the microfiber ionizing points. The conductive ionizing points and the conductive microfibers on the ionizing wire provide a path to ground for the charge. Suitable electrically conductive materials for the microfibers include, but are not limited to stainless steel, carbon, metal coated carbon, copper, metallized or metal coated acrylics, and conductive polymers. The entire ionizing wire can be fabricated from the conductive material or, alternatively, a conductive or non-conductive fiber core can be coated with a conductive material or metallized to form the electrically conductive microfibers. Further, non-conductive microfibers can be formed into a web and metallized, coated, or otherwise treated, after the web-formation process, and braided or otherwise adhered to the conductive wire core.

Preferred for the microfibers are solid stainless steel microfiber e.g., having between about 1 and about 10 microns in diameter. The microfibers can be fabricated by spinning, extrusion, drawing, or other known process for producing microfibers of the above-described diameter. The length produced by such processes, however, is normally far greater than that suitable for the relatively short microfibers described herein. The fibers can be cut (chopped) or otherwise shortened for use in the PIS of the present invention.

Optionally, other materials can be included or intermixed with the microfibers. For example, the fibers can be embedded in or coated with a matrix material, e.g. a starch, wax, or polymer, to aid in adhering the fibers to one another, and then wrapped around the wire core. Any such additional materials, preferably does not interfere with the electrical contact between adjacent fibers, and the ionization process at the points. Alternatively, the affixing of the microfibers to the wire core by the adhesive can also be done. Suitable materials for the adhesive layer include, for example, acrylic adhesives, or conductive adhesives such as an acrylic incorporating silver coated nickel particles (e.g. Type 9703 adhesive, available from Minnesota Mining & Manufacturing, St. Paul, Minn., or ARclad conductive adhesives, available from Adhesive Research, Inc., Glen Rock, Pa.).

In a preferred embodiment, the microfibers having the ionizing points are braided or twisted onto the wire core. The ionizing points can be attached or secured to the wire core using any method. In another embodiment, the microfibers are attached using an adhesive, as described above.

In addition to using a wire core on which microfibers have been braided or twisted, other methods of suspending ionizing points can be used. For example, instead of using a wire core, suitable substitutes such as a conductive band or an extruded surface can be used. A surface extruded from the groove can be used to adhere microfibers having ionizing points. Similarly, a conductive band on which the ionizing points are attached can be suspended inside the groove.

In yet another embodiment, a core is optional. The microfibers can be interwoven and in electrical communication with one another can be used. The microfiber network can be grounded using another mechanism other than a conductive core, e.g., using a conductive wire attached to one end of the network. Similarly, an elastic fibers braided with microfibers having ionizing points can be suspended in the grooves. In an embodiment, the elastic cord is braided with a combination of the static control fibers and regular threads or yarns. The inner core of elastic, in one aspect, was stretched to 2.25 times its length and was braided on its outer surface while stretched. Before winding up, the cord was relaxed and returned to its original length. When employed in the PIS gap or groove the elastic is stretched and this reduces its diameter by about 50%. It is placed in the groove and is relaxed. As the diameter increases, it gets snug in the groove with some of its surface pushing up from the gap protruding out slightly at the top of the rounded open groove. This provides the ionizing points in the area near the top of the groove. Such a groove can be easily extruded into the shape needed. Elastic fibers allow one to more easily suspend the ionizing points in the groove because the fibers stretch into place when attaching or removing the ionizing points. In an embodiment, the elastic cord having a plurality of ionizing points can be suspended in a rounded gap, and protrude up near the top surface of the groove to provide the suspended points.

The wire core, in an embodiment, can be soldered to a portion of the grooved surface, or to a surface at the ends of the PIS. The wire core can also be attached mechanically using an adhesive, or by inserting the wire into a complementary insertion point or opening. Any other means for attaching (e.g., an attachment) or securing the wire core, having microfibers braided to it, can be used including those known in the art or developed in the future. Similarly, in the case in which no wire core is used, the microfibers themselves can be attached or adhered to the ends of the PIS so that they are suspended in the groove. In the embodiment in which an elastic cord having ionizing points attached thereof, hooks at ends of the PIS can be used, for example, for suspension of the cord.

In another embodiment, the ionizing points can be suspended with a rod (see U.S. Pat. No. 6,522,077), adjustable rods, or cables. The surface onto which the ionizing points can vary so log as the ionizing points are suspended, as described herein.

The invention relates to a surface with a plurality of grooves or channels which protect the ion points placed in space in the grooves to enhance ionization between the points and the charged surface passing nearby or placed overhead. As show in FIGS. 1A and 1B, the surface can consist of a series of "V" shaped grooves with a thin wire with microfibers all along its surface. The top of the grooves form the upper surface of the PIS of the present invention. The ionizing points are suspend just below the upper surface of the PIS with air space around the ion wire. This embodiment of the present invention enhances the ionization of the charge on the surface sitting or passing above to the many conductive or ionizing points causing the charge to be reduced substantially or removed. Also, the supportive surface can be constructed to provide support with a minimum of surface contact which would minimize voltage suppression and minimize surface contact and separation with the substrate, thus reducing static charge generation as sheets or parts come in contact and separate from it.

Figure 2A:
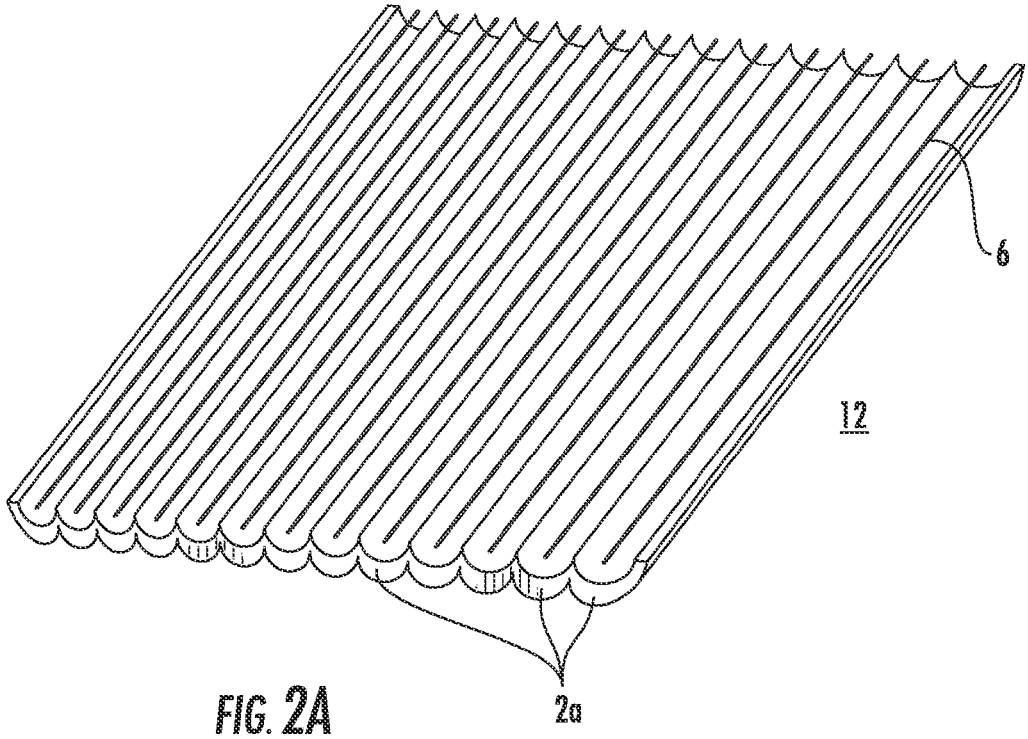
FIG. 2A is a drawing a perspective view of an embodiment of the present invention in which the grooves that create the air pockets for the suspended, ionizing wire is made by molded or formed plastic.
Figure 2B:
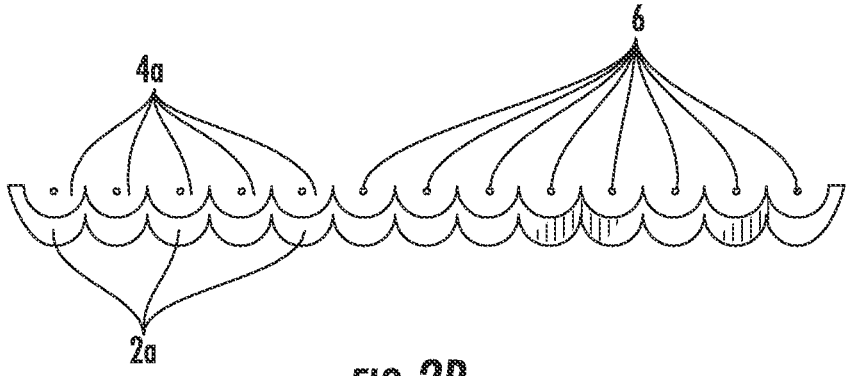
FIG. 2B is a drawing of a side view of the embodiment shown in FIG. 2A.
Figure 3A:
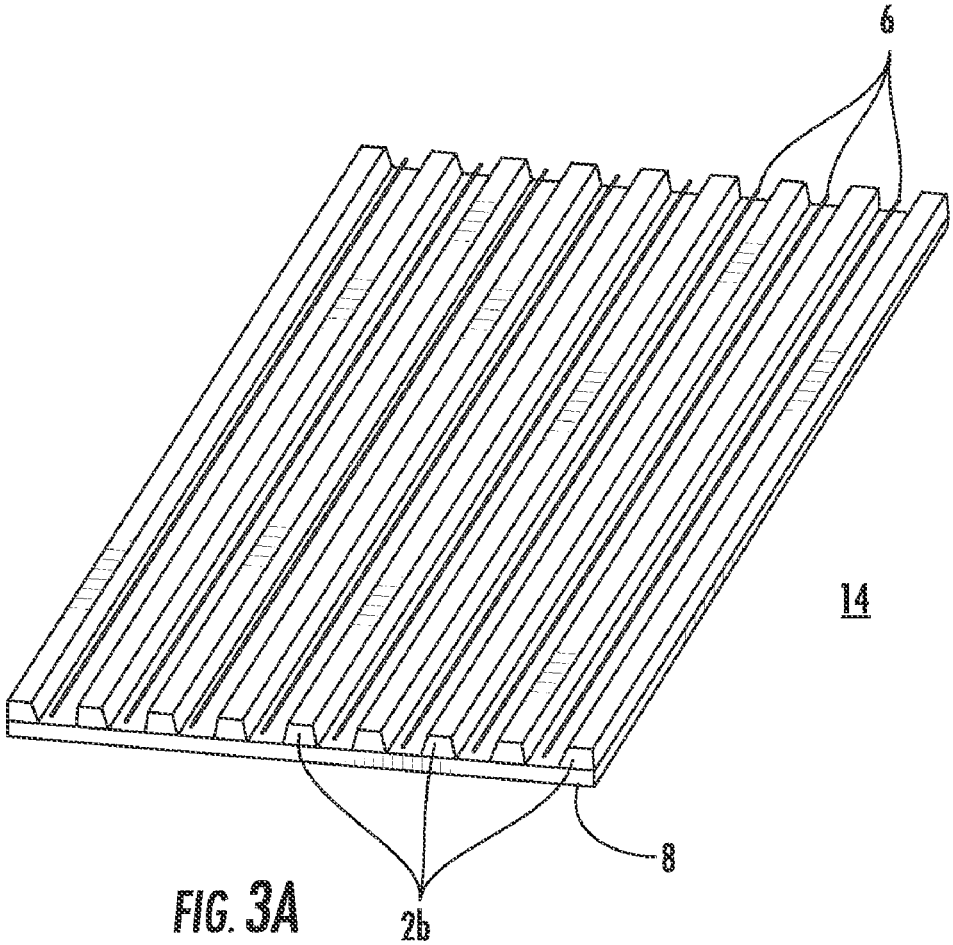
FIG. 3A is a drawing of a perspective view if an embodiment of the present invention that is made from a metal plate and a series metal bars that create grooves used to suspend the ionizing wire.
Figure 3B:
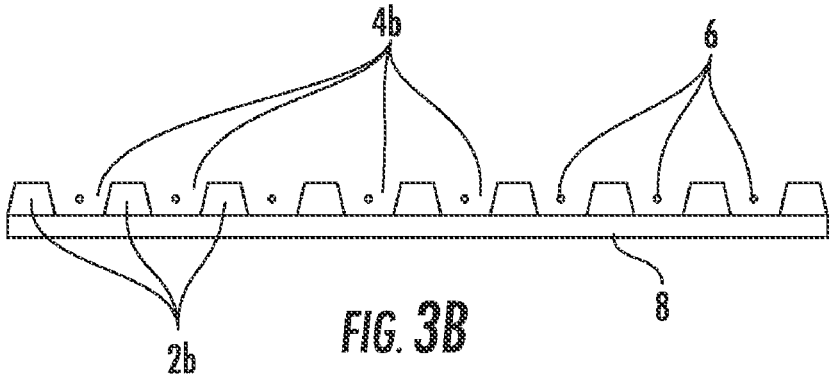
FIG. 3B is a drawing of a side view of the embodiment shown in FIG. 3A.

Referring to FIGS. 2A and 2B, grooves 2*a* of device 12 are made from a molded plastic form, and are shaped by a series of crescent moon or "C" shapes. Accordingly, the space created forms a semi-circle shape. As described above, the spaces can be formed by any shape groove. Similarly, the grooves of FIGS. 3A and 3B of device 14 are formed by a series of sloped or trapezoidal-shaped metal bars 2*b* that define space 4*b*. Metal bars 2*b* are attached or soldered to metal plate 8. As shown by the embodiments, the surface of the PIS can be made from any material that defines the spaces or channels, and includes insulative (e.g., plastic) or conductive materials (e.g., stainless steel, graphite), as described herein. Any material that defines channels for suspension of ionizing points known or developed in the future can be used with the PIS of the present invention.

With respect to FIG. 4A, PIS device 20 is made from foam base 16 having air chambers 4*c* in which wire 6*a* having ionizing points is suspended just below the upper surface of the device. In an embodiment, the upper surface is made from plastic and the body of the device is made from a foam tape. Wire 6*a* is held in place by an adhesive under the plastic. The wire is sandwiched between the foam and plastic, and is held about 5 mm below the surface. In an embodiment, plastic having the wire with suspended ionizing points can be provided with a release liner. The release liner can be removed and applied to an area of a machine over which insulative material passes. In addition to a foam base, the base can be made of any material, as described herein, that provide channels or slots for suspension of the ionizing wire. In an embodiment, foam can be substituted with plastic, paper or film e.g., treated with silicon. For example, metal base 18 of PIS device 30 has a series of channels in two directions to form a grid pattern of channels. See FIGS. 5A and 5B. The metal base can be machined to provide a slot for the ionizing wire to be placed across the base, along the center of the cut openings. The ionizing wire is suspended through a row of channels, just below the upper surface. This embodiment can be used in medical, pharmaceutical and food preparation settings. The metal base can be washed, sanitized and reused. The ion wires can be reused as well, or replaced after use. In this and any embodiments described herein, ionizing tape and other static eliminators can be use in conjunction with the PIS device of the present invention.

In other aspects, there are applications of the present invention where submicron conductive fibers could be coated on a sub-micron support fiber or wire. This can be accomplished under microscopic assembly. Such a sub-micron PIS can be very useful in getting under materials and sheets moving through a machine, because its thickness is reduced dramatically allowing sheets to flow over it. This would allow the groove to be dimensionally smaller. Thus, it will be easier to retro-fit a surface having issues with static cling.

Also, the PIS of the present invention could be incorporated into plastic or metal surfaces which would make such surfaces not only less prone to charge development, but also they would be self discharging into the air as in aircraft surfaces, oil and flammable liquid storage surfaces, non sparking surfaces both metal, plastic and combinations of conductive are insulative cores.

Figure 6A:
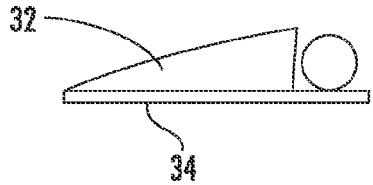
FIG. 6A is a side view of an embodiment of the present invention having a tapered extrusion that creates a gap, next to which the ionizing wire is disposed.
Figure 6B:
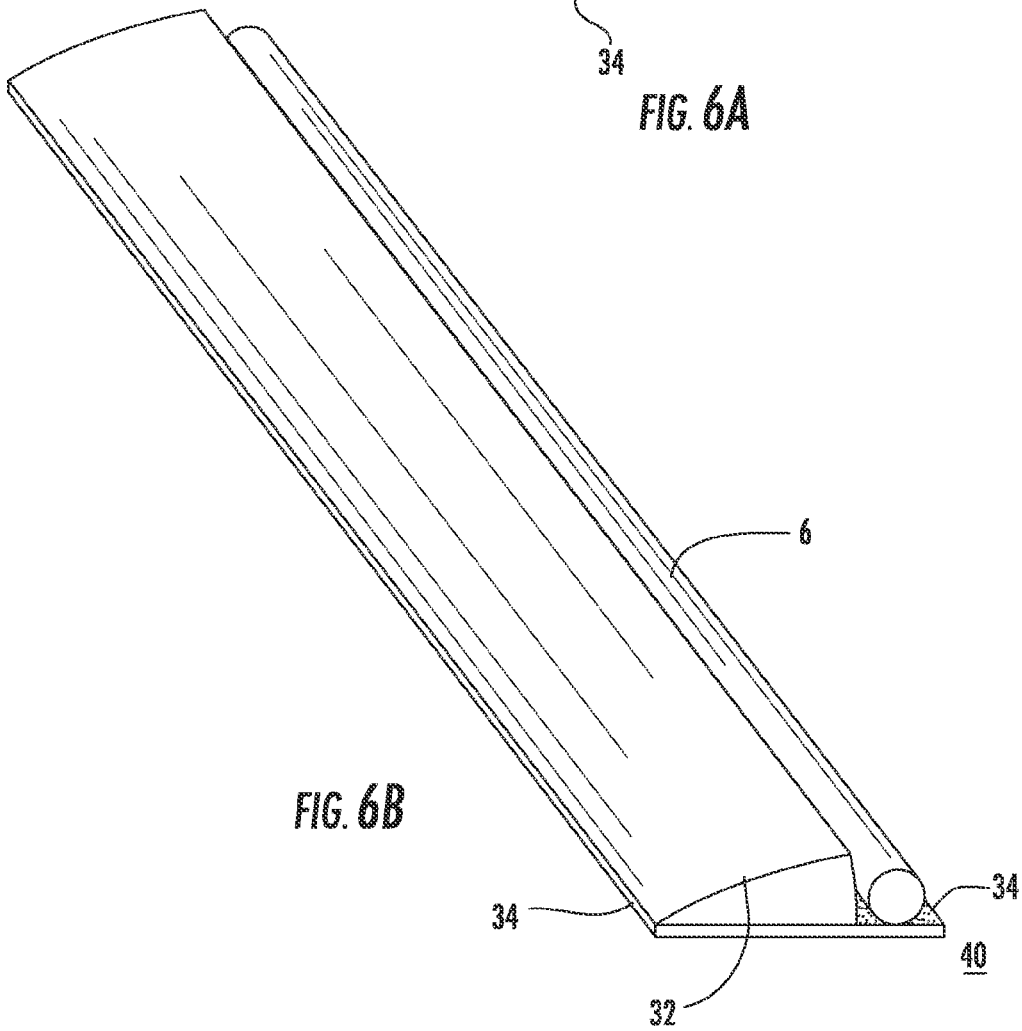
FIG. 6B is a perspective view showing the top of the embodiment shown in FIG. 6A.
Figure 6C:
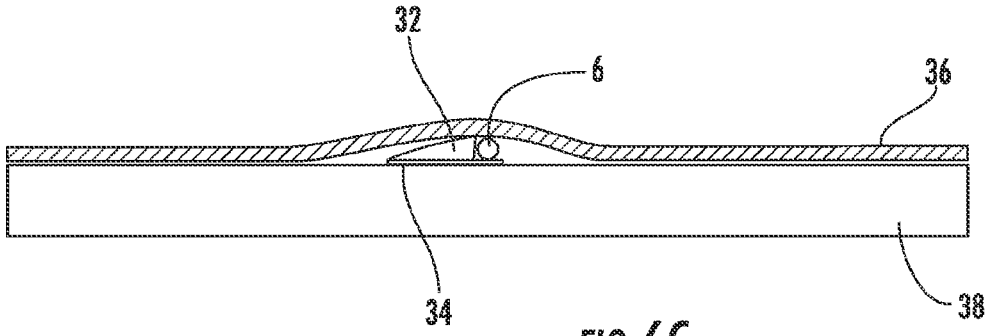
FIG. 6C is a side view of the embodiment shown in FIGS. 6A and 6B on a machine surface on which a plastic film is traveling.

Referring to FIGS. 6A, 6B, and 6C, the present invention includes device 40. Device 40 has a gap provided by tapered extrusion 32, that is laid on a surface having an adhesive, e.g., double faced tape 34. The tapered extrusion creates a gap (also referred to herein as a "groove" and can be used interchangeably) into which the ionizing points can be suspended. The tapered extrusion is a wedge having two sides. The extrusion tapers from a side having a higher height to one with lower height (or almost no height). The wire having a plurality of conductive, microfiber, ionizing points is laid on the tape next to and just below the top surface of the extrusion. See FIG. 6A. The side with the higher height creates a gap or groove in which the ionizing points can be disposed or suspended. This embodiment provides a plurality of conductive ionizing points, suspended just below the surface of the machine. The top view of this embodiment is shown in FIG. 6B in which the ionizing wire is shown next to the tapered extrusion. The extrusion can be made from plastic or many other materials including static dissipative or conductive, as described herein. When in use, as shown in FIG. 6C, there is only a slight rise over which paper or plastic film 36 can travel over machine surface 38 with minimal or no disruption to its flow. Yet, static charge is reduced or prevent. This embodiment provides one of the smallest profiles to lower the static to solve problems described herein. This device will lower the charge to an acceptable level so as not to interfere with the use of the machine.

The following explanation of the mechanism by which the PIS of the present invention operates inductively is presented as an aid to understanding of the invention, and is not intended as a limitation on the invention described herein. The surface charge on a moving material, e.g. a sheet material, creates a voltage field around the material. Enough of the microfiber ends are sufficiently close to the exposed surface and are sufficiently small in diameter to act as the above-described ionizing inductive points. That is, the statically charged material's electric field becomes concentrated at these microfiber ionizing points at the surface as the charged material passes, ionizing the air between the charged material and the microfibers. The surface charge then flows across the ionized air and through the conductive microfibers to ground.

Alternatively to grounding the PIS for inductive static control, a voltage can be applied to the microfibers from an external voltage source by conventional means, the voltage being sufficient to ionize the air immediately adjacent the exposed surface of the microfibers to neutralize the excess surface charge on the material passing near the PIS. Typically, an ac or dc voltage source is used to produce both positive and negative ions, the voltage being capacitively coupled to the microfibers through an insulator, in a conventional manner, to avoid discharge of voltage from the microfibers. The passing charged material then attracts either positive or negative ions to neutralize its surface charge. Also alternatively, a pulsed ac or dc voltage source or a piezoelectric or other voltage source can be used to provide the ionization required to neutralize the surface charge.

In one aspect, the present invention can be used with printing machines. Prior to the present invention, one who prepares a plastic sheet for screen printing can encounter certain problems. Generally, the sheet is placed on a table and wiped clean of dust with a wiper or tacky cloth or tacky roller. Unstacking, sliding, stripping a protective layer on the surface, wiping, tacking lifting and sliding of the plastic sheet, for example, can generate static on the sheet. Because the sheet is laying flat, most of the voltage is suppressed and induces (e.g., clings) toward the work surface. When the sheet is lifted the voltage field induces out in all directions. This attracts dust and when the sheet is screen printed, the voltage field can affect print quality (e.g., edging effects, threading and fogging of ink particles etc.). Static eliminators that are placed above the sheet cannot remove the charge because the voltage is suppressed. When the charge surface is actively inducing toward a surface, such as the table there is no voltage inducing out from the upper side of the sheet.

The PIS of the present invention is placed under the moving sheet on the work surface itself, and can effectively ionize the charge from under the sheet. In an embodiment, the PIS of the present invention can also be part of the work surface itself. The PIS device of the present invention can also be positioned in gaps between parts of the printing machine. Alternatively, a low profile PIS can be placed under the moving sheet and the low profile still allows the moving sheet to pass over it without jamming. In one embodiment, the thickness of the device is minimal so that the surface PIS is able to get under or onto a surface of a machine that demands a very flat surface to pass over. In this embodiment, very small inductive points suspended in air in a small air space or grove is preferable. In an embodiment, the smaller the profile, the better so the PIS can be placed on feed boards, work tables, etc. In many uses or applications, the sheet is placed down on a surface. While the statically charged sheet is being printed and dried with UV exposure, it gets charged with static due to high voltage induction from the printing head (e.g., during digital printing). Also in screen printing, the wiping action of the squeegee as it passes across the screen and over the media plastic sheet can generate static on the media. Subsequent printing on the charged media can cause printing defects, e.g., threading of ink, fogging, ink movement and the media never leave contact with the flat surface of the machine. This is very common in ink jet printing where microscopic ink particles are propelled through air onto the media (plastics, foam, wood, etc.). The static charge causes the particle to be attracted or repelled and it deposits on the wrong spot.

Wide format digital printing is another application that can use the PIS device of the present invention. Wide films and rigid sheets are pulled into a wide format printer and pass under a moving print head that emits small droplets of ink onto the surface creating a large graphic. Static charge buildup occurs during printing when rubber pull rollers charge up a plastic substrate. Since the surface is in contact with the flat bed of the machine, the static on it often cannot be removed from above it conventionally. However, when the very small droplets of ink are discharged onto the charged surface, they are affected by the charge very close to the surface and are repelled or diverted from depositing on the surface accurately. This can distort the printed image and its is sometimes described as fogging where small particles are deposited in lighter areas of the graphic. The present invention is used to remove the charge from the surface very close to where the ink is deposited as friction e.g., by placing the PIS device, described herein, between the plastic and the machine, position where static would otherwise regenerate. Placing ionizing tape, described herein, by itself below the moving sheets results in overcoming voltage suppression. However, after use, the microfibers become pressed and abraded, accordingly less efficient. Also, contact of the passing sheet coming in direct contact with the ionizing tape contaminates and damages the tape. Hence, the suspending the ionizing points just below the upper or outer surface of device provides protection of the ionizing points. By opening grooves into the surface and suspending the fibers in the air of the grooves dramatically improves the removal of static charge from objects placed on or moving across the grooves and the grooves protect the ionizing points from damage or abrasion.

The PIS device of the present invention can also be used in a tote box. In particular, the present invention can be used on the inside surface of a tote box and grounded. As statically charged plastic are placed into the box, the charge is reduced to a low level. As the parts are moved, the device of the present invention minimizes regeneration and reduces charges if they develop. Various surfaces in the system could be grounded to enhance the lowering of charge or a small charge could be put on the PIS to neutralize activity. Additionally, plastics which are placed in a tote box also generate static. Tote boxes can be lined with the PIS of the present invention and stop plastics and other objects from redeveloping static as they move during transport. In an embodiment, grooves can be molded into the plastic transport tray on the inside or outside of one or all sides of the tote box, so it does not develop static from function with conveyor belts. Elastic members having ionizing points can be placed in grooves in a tote box being held in place by its expansion.

In yet another embodiment, there is a need for providing a clean durable surface with the suspended points in grooves when dealing with film. The present invention includes methods of using the PIS of the present invention when working with film. For example, the PIS of the present invention can be used with a table or work surface (e.g., removably or permanently placed) so that when film is handled, the static charge that is generated by stripping, wiping, tacking, sliding, tumbling, etc is eliminated or reduced to a lower level.

Manufacturers of machines can build the PIS of the present invention into the flat surfaces of their machines. For example, the feed board of a printing press can be grooved to hold the points. Also, in screen printing and in wide format digital printing there is a flat surface under the print head with holes which pull a vacuum to hold the media in place during printing. This surface can be grooved to hold the microfiber points. In other applications, machine manufacturers can simply provide a gap and cover it with a PIS tape. Accordingly, the present invention relates to a system or assembly having the PIS of the present invention.

EXEMPLIFICATION

An ion wire was centered and suspended in a groove cut into a polycarbonate block. When a charged piece of tape is drawn across the groove, the static is dissipated as follows:

TABLE 1

| Initial Charge | Opening Size | Residual Charge |
|---|---|---|
| 8-12 KV | 0.125" | <2 KV |
| 8-12 KV | 0.0625" | <2 KV |
| 8-12 KV | 0.05 | <4 KV |

These data resulted from applying a known static charge to a thin film and passing it over the gap and recording the reduction in static on the surface. The above-results demonstrate that suspension of a plurality of ionizing points works effectively and efficiently.

A variety of extended plastic sheets with groves were tested using the wire and the elastic in the grooves. Both the wire and the elastic had a plurality of ionizing points, each with similar results. Slots in rigid thin film were die cut and the ion wire was attached across the underside. See FIGS. 4 and 5. A thin plastic which has adhesive on one side was die cut. Wire having ionizing points was placed down the center so it was held in place by the adhesive. This product was placed over a groove or space on a machine surface. The groove or space provides air space under the iron wire. The plastic film protects the wire from above. In addition, a layer of foam tape was placed on the back to increase the thickness under the wire to provide air around the iron wire.

The extended plastic profile with the double faced tape was also made using foam which was 1/16" thick and it was effective.

Tape with Die Cut Openings and Ion Wire

Tape manufactured as described with die cut slots. The ion wire is applied to the adhesive across the slots and a release paper is applied. The user removed the release paper and applied the ion wire tape across a space or gap on a surface. The gap or groove on the surface allows the ion wire to be suspended in air space. The thin rigid plastic film protected the suspended points from contact from above.

Figure 4A:
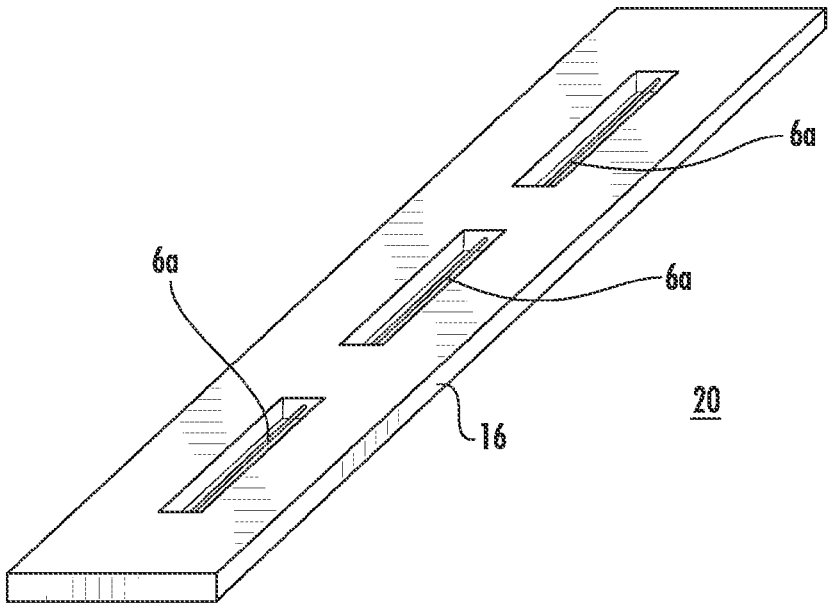
FIG. 4A is yet another embodiment of the present invention of a protective ionizing surface that includes a series of 3 air pockets in which an ionizing wire is suspended.
Figure 4B:
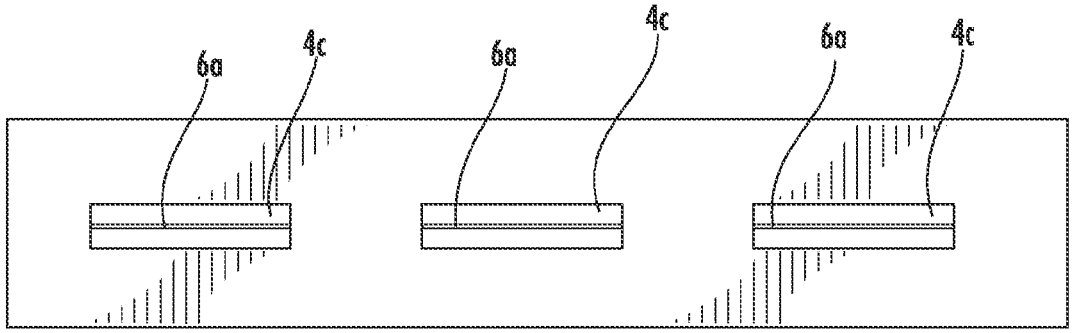
FIG. 4B is a top view of the embodiment showing in FIG. 4A
Figure 5A:
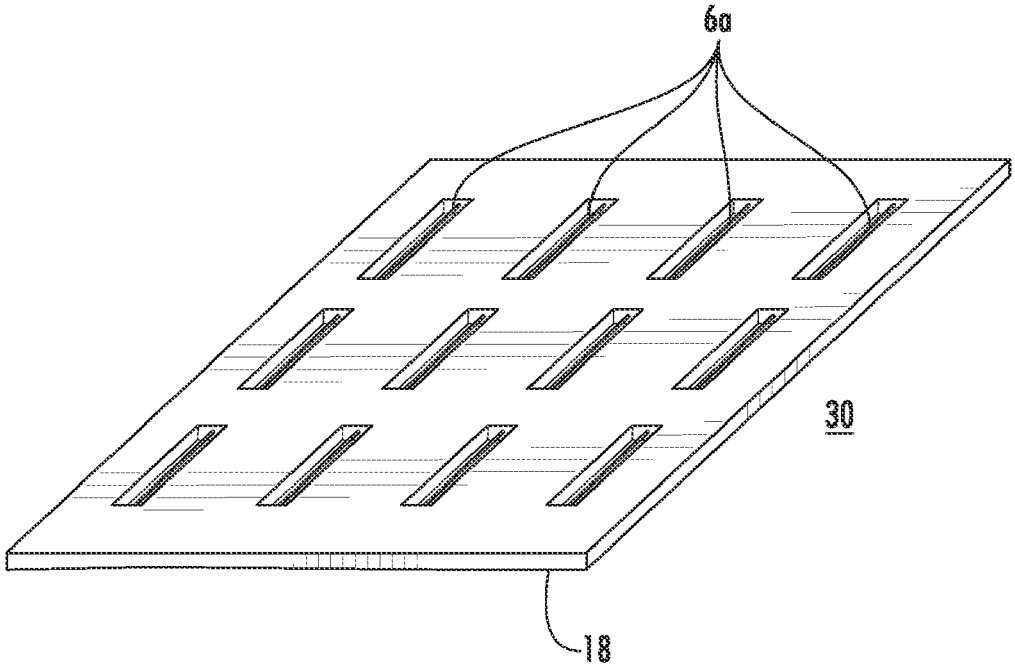
FIG. 5A is still another embodiment of the present invention, which is similar to that shown in FIG. 4A, but utilizing a grid of air pockets to suspend multiple ionizing wires.
Figure 5B:
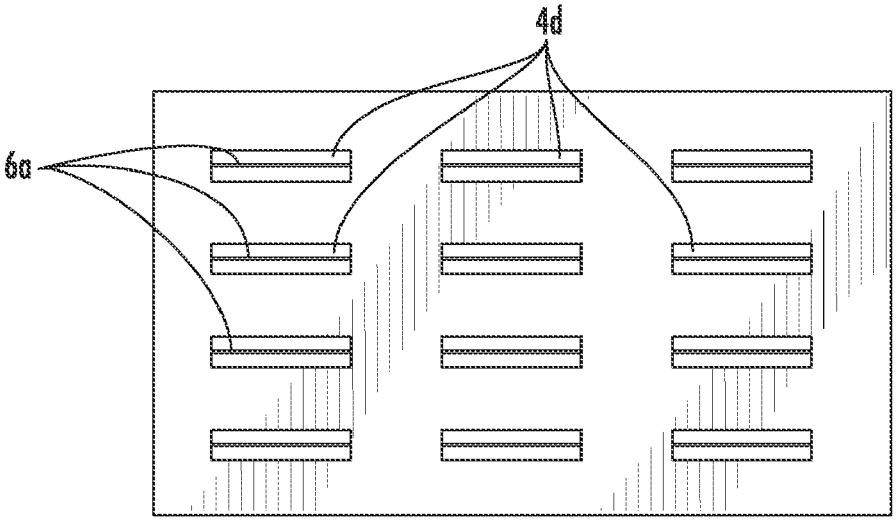
FIG. 5B is a top view of the embodiment shown in FIG. 5A.

Flexible plastic adhesive tape of a thickness of about 5 mils and a width of 1" was unwound and die cut with a slot was done, as shown in FIG. 4A. After die cutting the conductive points in the form, a thin wires were placed on the adhesive side of the tape holding them in place below the top surface and exposing them in space across the die cut windows. A release liner is then placed on the sticky or adhesive side of the tape and it is rolled up. Foam can be added to this tape to raise its thickness and provide an air gap under the points to enhance the field and reduce capacitance.

Tape with Tapered Extrusion

Double faced tape was applied to a tapered extrusion of plastic. Extrusion of plastic with a number of grooves was made and ion wire was suspended in each of the grooves. An extrusion of plastic with grooves was also designed to hold elasticized ionizing cord. These extrusions can be cut into modules which can be brought together e.g., work surfaces such flat carrier for parts, tote box bottom, etc.

Ionizing Wire

A wire was selected based on conductivity strength-to-diameter. The wire was fed into a braiding machine and the outside was braided with a mixture of stainless steel fibers with 20% by weight having an average 7 microns in 1-3 inches blended with polyester threads for strength. The braided wire is flexible enough to wind. The braiding exposed the conductive micro fiber points.

The relevant teachings of all the references, patents and/or patent applications cited herein are incorporated herein by reference in their entirety.

While this invention has been particularly shown and described with references to preferred embodiments thereof, it will be understood by those skilled in the art that various changes in form and details may be made therein without departing from the scope of the invention encompassed by the appended claims.

What is claimed is:

1. A protective ionizing device having an upper surface, the device comprises:

a. a surface having a series of grooves, each groove defines a space; and b. a plurality of electrically conductive microfibers having a multiplicity of ionizing points suspended in the space below the upper surface, wherein when the device is grounded, air between the ionizing points and material passing by said upper surface is sufficiently ionized to remove or reduce static charge from said material.

2. The protective ionizing device of claim 1, wherein the device has a profile ranging between about 1/32 inch and about 1/4 inch.

3. The protective ionizing device of claim 1, further including a wire core suspended just below the upper surface, wherein said microfibers braided along the at least a portion of the length of the wire core.

4. The protective ionizing device of claim 1, wherein the device is adapted for use in an apparatus through which insulative material flows or is propelled.

5. The protective ionizing device of claim 1, wherein the wire core is suspended at a distance between about 1/64 inch and about 1/8 inch below the upper surface.

6. The protective ionizing device of claim 5, wherein the wire core or electrically conductive microfibers are made from carbon, metal coated carbon, copper, stainless steel, metal coated acrylic, metallized acrylic, electrically conductive polymers, static dissipative polymers or any combination thereof.

7. The protective ionizing device of claim 1, wherein the microfibers have a diameter between about 0.5 and 50 μm and a length between about 1/8 inch and 3 inches.

8. The protective ionizing device of claim 1, wherein ionizing points are suspended on braided microfibers, on an extruded surface in the groove, on an elastic cord, or on a wire core.

9. The protective ionizing device of claim 1, wherein the surface is made from a material selected from an insulative material, semi-conductive, or a conductive material.

10. The protective ionizing device of claim 9, wherein the material is selected from plastic, metal, foam, paper, film, textile, wood, or any combination thereof.

11. A protective ionizing device having an upper surface, the device comprises:

a. a surface having one or more groove, wherein each groove defines a space;

b. a plurality of electrically conductive microfibers having a multiplicity of ionizing points suspended in the groove and below the upper surface, and c. a tapered extrusion.

12. A protective ionizing device having an upper surface, the device comprises:

a. a surface having a tapered extrusion made from insulative material, the tapered extrusion is created from a first side having a first height that slopes to a second side having a second height that is less that the first height; and b. a plurality of electrically conductive microfibers having a multiplicity of ionizing points suspended along the first side just below the upper surface.

13. An apparatus through which insulative material flows or is propelled, the apparatus includes a protective ionizing device having an upper surface, the device comprises:

a. a surface having a series of grooves, each groove defines a space; and b. a multiplicity of ionizing points suspended in the space, just below the upper surface;

wherein the device is positioned proximal to or on a surface at which insulative material flows or propels.

14. A system that provides a protective ionizing surface, the system comprises:

a. an apparatus through which insulative material flows or is propelled; and b. a protective ionizing device having an upper surface, the device comprises:

i. a surface having a series of grooves, each groove defines a space; and ii. a multiplicity of ionizing points suspended in the space, just below the upper surface;

wherein the device is positioned proximal to or on a surface at which insulative material flows or propels.

15. A method for removing static charge or reducing static charge on a surface of insulative material, the method comprises:

subjecting the static charge to a protective ionizing device, the device includes an upper surface, a surface having a series of grooves, each groove defines a space;

and a multiplicity of ionizing points suspended in the space, just below the upper surface, wherein the device is grounded;

wherein the air between the ionizing points and material subjected thereto is ionized to remove or reduce static charge from said material.

16. The method of claim 15, further including positioning the protective ionizing device underneath insulative material being propelled.

17. A protective ionizing kit, the kit comprises:

a. a surface having a series of grooves, each groove defines a space;

b. a wire core suspended just below the upper surface; said wire core having a plurality of electrically conductive microfibers having a multiplicity of ionizing points, said microfibers braided along the length of the wire core;

c. an attachment for attaching the wire core to a machine.

* * * * *